United States Patent [19]

Fedeli

[11] Patent Number: 4,656,779

[45] Date of Patent: Apr. 14, 1987

[54] BLOCK SYSTEM FOR DOORS, WINDOWS AND THE LIKE WITH BLOCKING MEMBERS AUTOMATICALLY SLIDED FROM THE DOOR FRAME INTO THE WING

[76] Inventor: Benedetto Fedeli, Piazza dei Sanniti, 11, Roma, Italy

[21] Appl. No.: 498,098

[22] Filed: May 25, 1983

[30] Foreign Application Priority Data

Nov. 11, 1982 [IT] Italy ..... 49487 A/82
Jan. 5, 1983 [IT] Italy ..... 47604 A/83

[51] Int. Cl.[4] ..... E06B 7/28
[52] U.S. Cl. ..... 49/318; 49/321
[58] Field of Search ..... 49/318, 317, 316, 395, 49/319, 320, 321

[56] References Cited

U.S. PATENT DOCUMENTS 1,178,775 4/1916 Albright ..... 49/318
2,207,065 7/1940 McCormick ..... 49/318
2,805,451 9/1957 Evans et al. ..... 49/318

FOREIGN PATENT DOCUMENTS 185881 8/1936 Switzerland ..... 49/318

*Primary Examiner*—Philip C. Kannan
*Attorney, Agent, or Firm*—Young & Thompson

[57] ABSTRACT

A blocking system for doors, windows and the like, particularly of the armored type, to have antitheft, antibreaking, fluid-tight and soundproof features, comprising a frame (11), a wing (12) and two pairs of mechanically interconnected blocking members (13,13'-14,14') which are arranged in housing slots (15,15'-16,16') provided along the opposite perimetrical flat inner edges of the frame (11) and sliding into facing slots (17,17'-18,18') of the wing (12) by the tension action of springs (34,34') to close the door, the backwards motion of these blocking members being carried out by the pushing action of a pin (38) which is manually operated through a central control device (20), when the door is to be opened. The outwards and backwards motions of the blocking members are synchronous and the outwards motion of same from the housing slots of the frame into facing slots of the wing is automatically provided by means of the tension of springs (34,34').

3 Claims, 9 Drawing Figures

BLOCK SYSTEM FOR DOORS, WINDOWS AND THE LIKE WITH BLOCKING MEMBERS AUTOMATICALLY SLIDED FROM THE DOOR FRAME INTO THE WING

The invention relates to a blocking system for doors, windows and the like, particularly of the armoured type, comprising two pairs of blocking members which are fully housed inside respective housing slots along the opposite perimetrical flat inner edges of the door frame when the door is to be in its open condition, and are automatically slid from said housing slots so that partial protrusions of the same are inserted into facing perimetrical slots of the door wing when the door is to be in its closed condition. The automatic sliding motion of the blocking members outward of their respective housing slots is carried out by the action of springs, while a draw back sliding motion of same is carried out by manually controlling a suitable central control device provided within the door wing.

In accordance with the invention it must be pointed out further that the blocking members are mechanically connected to each other by interconnecting means operating at the four angles of the door frame, so that they are moved synchronously either from the door frame into the wing to block the door wing or wings in its closed position, and from the wing to the frame so that the wing is free for angular movements when the door is open, after such a suitable central control device has been controlled manually for that purpose.

The use of such a blocking system improves the antitheft and antibreaking features of the closed door with the further addition of fluidtightness and soundproof.

It is well known that, particularly in recent decades, new solutions to securely block a door, window or the like have been proposed and/or applied. On the ground of his long experience as manufacturer and seller of armoured doors and safes, the Applicant believes that the suggestions and applications have until now been directed only to improve the blocking members and the means to move them from the wing into suitable holes or openings of the frame and floor, the use of a plurality of the blocking members having also been proposed and/or applied which may be driven with either horizontal or vertical motions. Such blocking means have generally a circular cross-section and it must be added that the use of blocking blades has also been proposed for particular applications.

However, in any case the proposed or applied blocking members in accordance with the prior art are always applied to the door wing and moved by suitable driving devices from the door wing into holes or openings of the door frame. Also when bars or blades extending along the entire height and width of a wing are used and moved in accordance with the prior art, the improvement could provide only an increase of the antitheft and antibreaking features of the door.

The invention as claimed is intended not only to increase the antitheft and antibreaking features of doors, windows or the like, but also to add fluidtightness and soundproofness to the same.

The advantages offered by the invention may be easily deduced by those skilled in the art from the detailed description reported hereafter with reference to the accompanying drawings which illustrate two specific embodiments. These latter do not limit the application of the invention, but are to be considered only as examples, so that modifications and/or changes suggested by those skilled in the art are possible and also of all within the scope of the invention.

Of these drawings

Figure 8:
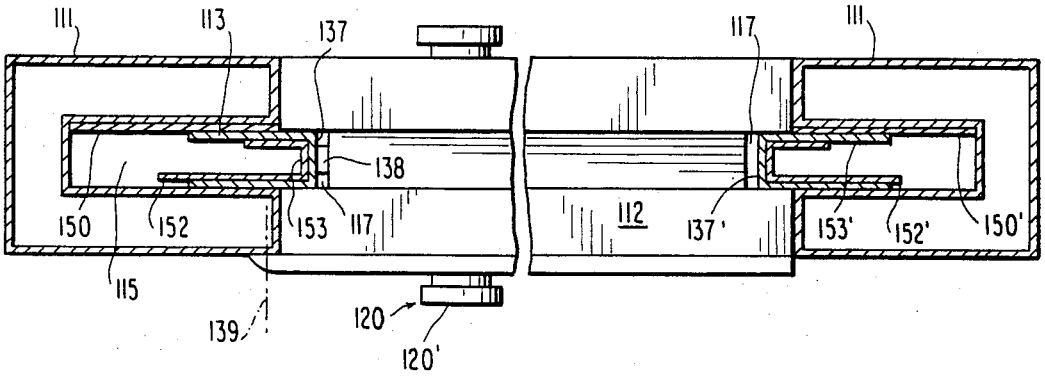
FIG. 8 is a cross-sectional view of a door according to the second embodiment of the invention, wherein the door wing is shown in its closed position.
Figure 9:
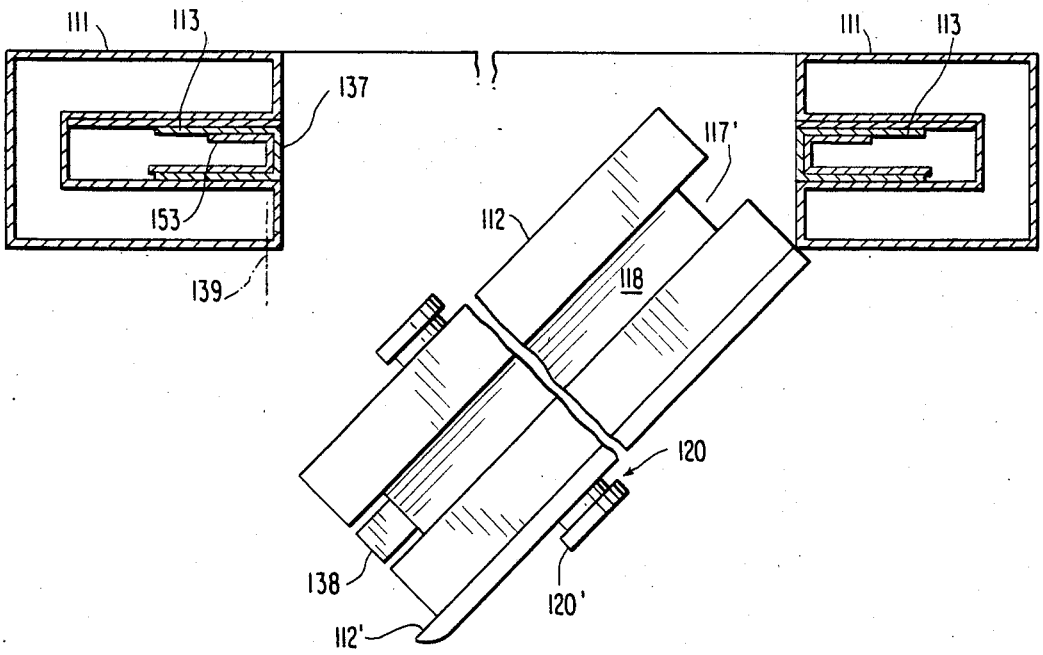

FIG. 9 likewise, a cross-section view of the door shown in FIG. 8 wherein, however, the wing is in a partially opened position.

Referring now to a first embodiment of the present invention illustrated in FIGS. 1 to 4, those skilled in the art may easily note that the door provided with the novel blocking system is generally indicated with the reference numeral 10 and comprises a door frame 11 and a door wing 12 hinged on the frame. Frame 11 is a solid armoured body having housing slots 15,15' along the opposite vertical flat inner edges and 16, 16' along the opposite horizontal flat inner edges of same, respectively. These housing slots have a rectangular cross-section and serve to house the respective vertical blocking members 13, 13' and horizontal blocking members 14, 14' which are fully inserted inside same when the door is in its open position, hereafter called the inactive position; and are slidingly moved partially outwards to block door wing 12 in its closed or active position.

According to this preferred first embodiment of the invention, door frame 11 has its lower end under the floor plane, so that the horizontal lower inner edge of the frame as well as that of wing 12 are at floor level.

Figure 3:
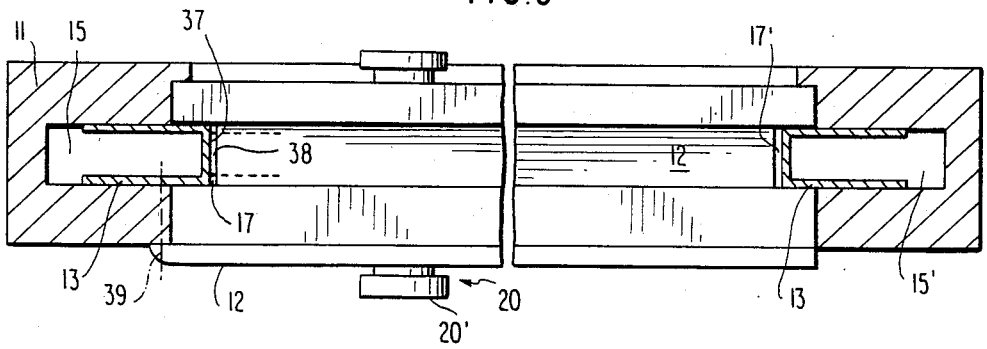
FIG. 3 shows a cross-section of a door in a closed position according to FIG. 1.

Door wing 12 comprises a solid armoured body hinged on frame 11 and provided with a protruding flange 12' the plane surface of which 12'' rests on the outer surface of frame 11 when the door is closed. The flat perimetrical outer edges of wing 12 are provided with slots 17, 17' along the opposite vertical flat outer edges as well as with slots 18,18' along the opposite horizontal flat outer edges of same. These slots have a rectangular cross-section which is facing the rectangular cross-section of respective housing slots of the frame, when the door wing is in its closed position, as shown in FIG. 3.

Figure 4:
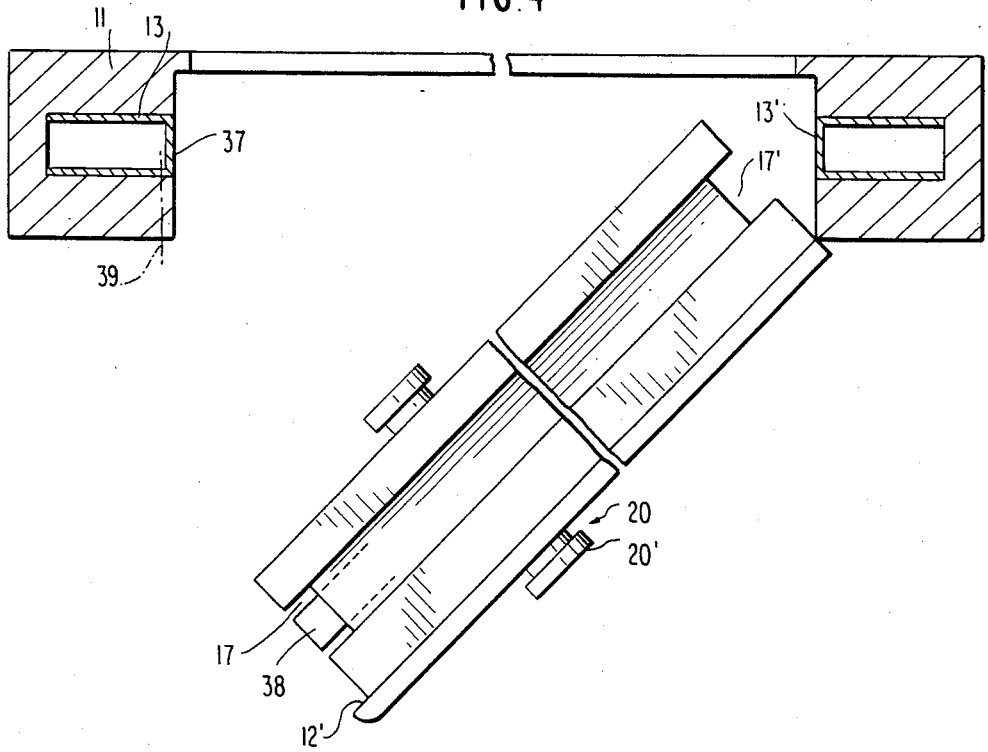
FIG. 4 is a cross-section view of a door according to the first embodiment of the present invention, wherein the wing is shown in its open position.

The blocking members of this block system in accordance with this first embodiment of the invention comprise a pair of bars or blades 13, 13' which are fully housed inside the opposite vertical housing slots 15, 15' of frame 11 and a second pair of blades or bars 14, 14' fully housed inside the opposite horizontal housing slots 16, 16' of frame 11 when the door is in its open position, retaining means (not shown) being provided in order to release wing 12 for a desired angular movement of same, as shown, for example, in FIG. 4. Only a symbolic dashed line 39 has been drawn in FIGS. 3 and 4 to indicate the use of a conventional device for that purpose.

Figure 1:
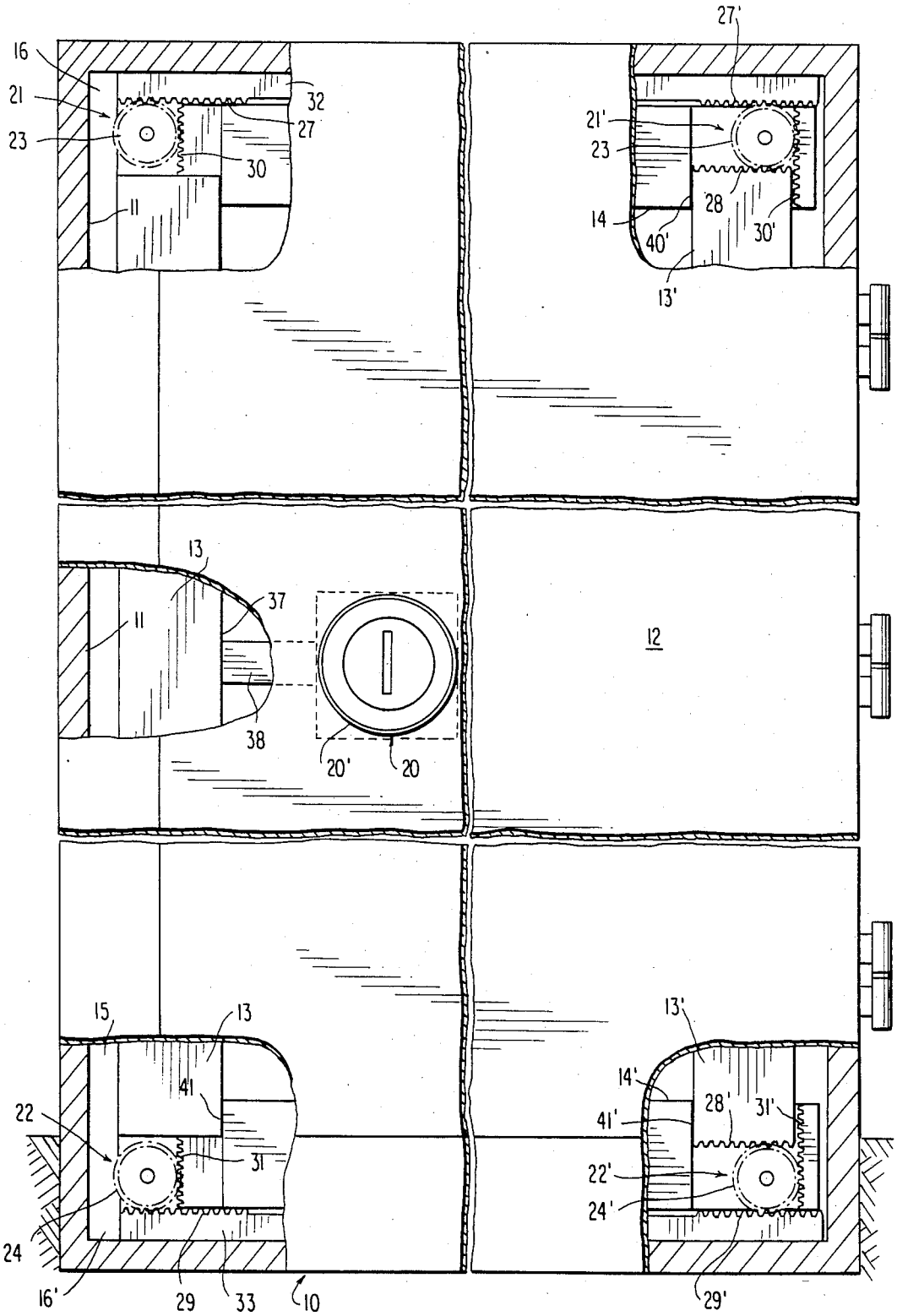
FIG. 1 shows a schematic front view of a door provided with blocking members interconnected by rack-and-pinion mating means in accordance with a first embodiment of the present invention, the door being shown in its closed condition.
Figure 2:
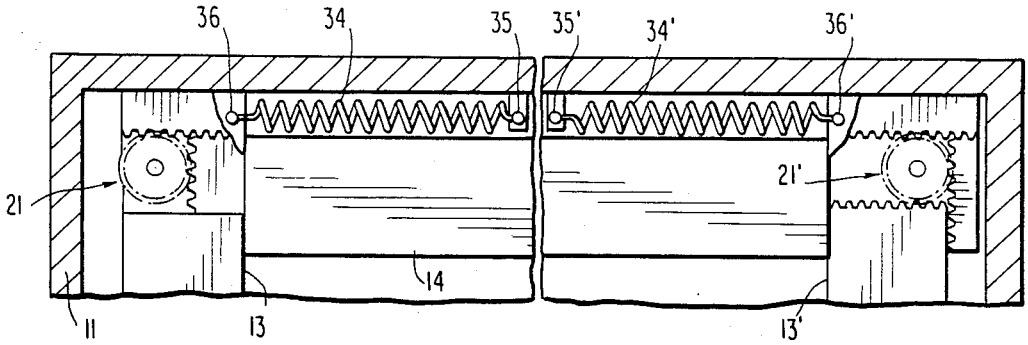
FIG. 2 is a partial front view of the door according to FIG. 1 wherein only a preferred example of springs are shown at the upper side of the frame to put the opposite vertical blocking members in their active position.

As premised, the blocking members of this blocking system are connected to each other, so that they are moved synchronously either outwards and backwards from and into respective housing slots in frame 11. A preferred embodiment of interconnecting means has been selected for both the first and the second embodiment of the present invention (this latter will be described later) and comprises a rack-and-pinion mating means type. In FIG. 1 four interconnecting means of this type are shown at the four angles of frame 11 and are indicated by reference numerals 21, 21'-22, 22'. These mating means comprise pinions 23, 23'-24, 24' rotatable about pins on frame 11 and mating with upper racks 27, 27' connected therebetween by an upper bar 32 in order to rotate in the same direction, such bar being secured to blocking means 13. Lower racks 29, 29' are similarly connected therebetween by a lower bar 33 and engage with pinions 24, 24', respectively. Lower bar 33 is also secured to blocking member 13, so that lower racks 29, 29' co-operate to rotate lower pinions 24, 24' in the opposite direction from upper pinions 23, 23', when blocking member 13 is moved outwards or backwards from or into housing slot 15.

As further shown in FIG. 1, upper and lower rack-and-pinion mating means 21' and 22' are also provided with auxiliary racks 28, 28', respectively, these latter being fastened to the opposite ends of vertical blocking member 13' and operating at the diametrically opposed side of respective main racks 27', 29', so that vertical blocking member 13' is moved synchronously in reverse direstion in respect to the opposed vertical blocking member 13, in accordance with the present invention.

In order to move synchronously also the opposite horizontal blocking members 14, 14', rack-and-pinion mating means 21, 21'-22, 22' are also provided with vertical racks 30, 30'-31, 31', respectively which are fastened to the opposite ends of upper horizontal blocking member 14 and lower horizontal blocking member 14', respectively.

It is thus possible to move all the four blocking members 13, 13'-14, 14' synchronously from or into respective housing slots 15, 15'-16, 16' of door frame 11 and consequently block or release wing 12.

As premised, the outwards movement of the blocking members from their respective housing slots in frame 11 is not only synchronous but also automatic in order to block automatically the door in its closed position—as shown, for example, in FIGS. 1 and 3. Such an automatic outwards movement of the four blocking members and the consequent partial protrusion of these latter from the respective housing slots and insertion into facing slots of wing 12 is carried out by using suitable elastic means shown here as tension springs illustrated in FIG. 2 in relation with the upper portion of door 10. A pair of tension springs 34, 34' is provided within upper housing slot 16 of frame 11. One end of each spring is hooked to a protruding pin 35, 35' of the frame, respectively, while the other end 36, 36' is hooked to the respective movable blocking members 13, 13'. Similar tension springs are obviously provided within housing slot 16' at the lower portion of frame 11 while such other springs are not shown in the drawings to simplify the illustration.

Because of this possible action of tension springs and the novel interconnection of all the four blocking members of the blocking system, these latter may synchronously and automatically be drawn out from respective housing slots in the frame and inserted into facing slots of wing 12 to block the door in its closed position, as shown, for example, in FIGS. 1 and 3. To open the door and freely move wing 12 angularly it is necessary to push only one of the blocking members into its respective housing slot thereby to retain the blocking members within the same.

To satisfy these conditions a single pin 38 is provided to be slidingly driven when the operator controls manually a central control device 20 through knob or handwheel 20'. Pin 38 is always in contact with outer face 37 of vertical blocking member 13 and is moved backwards when blocking member 13, as well as all the other blocking members 13', 14 and 14' connected thereto, are to be drawn out from respective housing slots in frame 11 when wing 12 is to be blocked in its closed position. The outwards motion of pin 38 is carried out by a corresponding operation of control device 20 and blocking member 13 is consequently pushed into its housing slot 15 so that wing 12 is set free. The angular movement of this latter is however possible only when blocking member 13, and consequently all the other interconnected blocking members 13', 14, 14', is retained fully inserted in its housing slot 15 of frame 11, as said above. For that purpose a conventional device may be used and that which has been illustrated and described in Italian patent No. 49487/82 filed on Nov. 15, 1982 by the applicant is here recalled as an example. A symbolic dash line indicated in the drawings (see FIGS. 3 and 4) with reference numeral 39 relates to such a conventional device.

Turning now to FIGS. 5 to 9, a second embodiment of a block system according to the present invention is illustrated which differs from the described first embodiment particularly as to the door frame structure and support means of the racks.

Door frame 111 of door 110 has a hollow structure which is formed of steel plates solidly connected to each other in a conventional manner, e.g. by riveting or soldering same as that vertical housing slots 115, 115' and horizontal hosing slots 116 are provided along the opposite vertical flat inner edges and opposite horizontal flat inner edges of frame 111, respectively.

As in frame 11 of the first embodimente, said housing slots have a rectangular cross section, wherein rack-and-pinion mating means 121' are provided and operating at the four angles of the frame, in order to interconnect blocking members 113, 113'-114 and move the same in accordance with the present invention. All the four mating means are constructed and operate likewise, so that only one is detailed in FIGS. 5 to 9 and comprises mating means indicated with reference numeral 121' which is provided at the upper right angle of frame 111 within the hollow structure of this latter.

Figure 5:
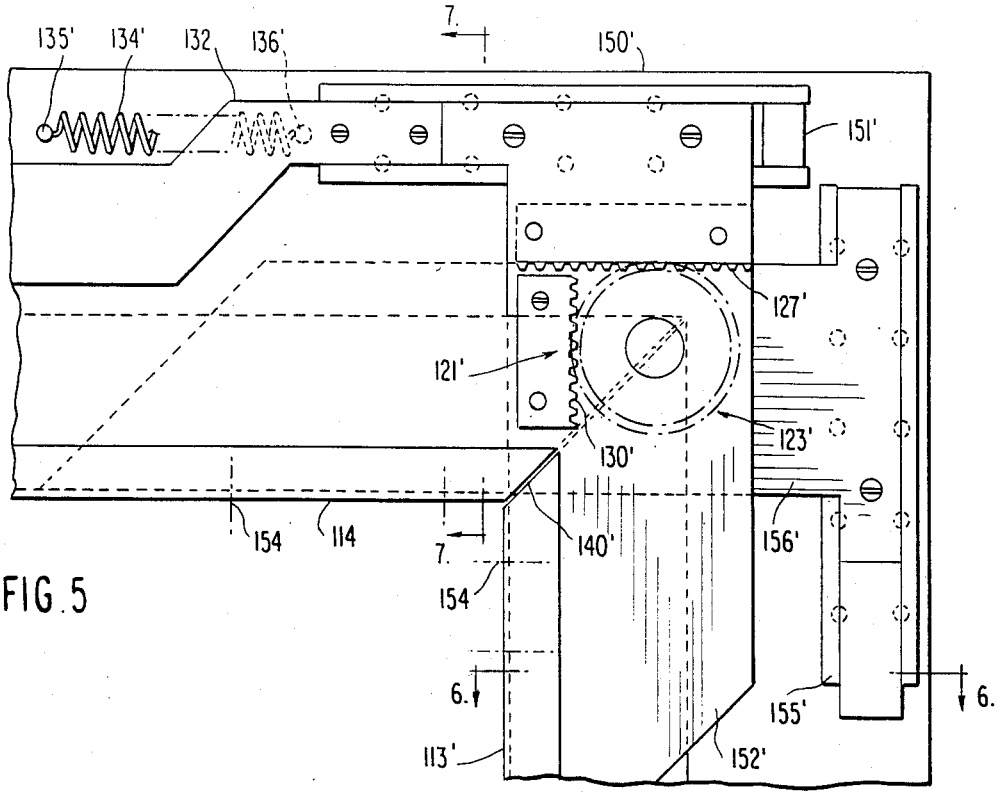
FIG. 5 is a front elevation view of a detailed interconnecting means at one of the four corners of the door frame as a partial sectional view in accordance with a second embodiment of the present invention.

Mating means 121' comprises a main support steel plate 150' fixedly secured to an inner wall of respective housing slot 115' of frame 111. A horizontal sliding ball bearing 151' hase its base fastened to support plate 150' and a vertical sliding ball bearing base is fastened also to this latter support plate. On the sli-ding member of sliding ball bearing 151' is fastened, for example by screws as shown in FIG. 5, a vertical plate 152' which is thus moved horizontally therewith. Likewise, on the sliding member of vertical sliding ball bearing 155' a horizontal plate 156' is screwed. As shown, to vertical plate 152' a horizontal rack 127' is screwed, while to horizontal plate 156' is screwed a vertical rack 130'. The rack-and pinion mating means 121' is completed by pinion 123' which is pivotable on a pin of frame 111, and is disposed at the upper right angle of frame 111, as said above.

Figure 6:
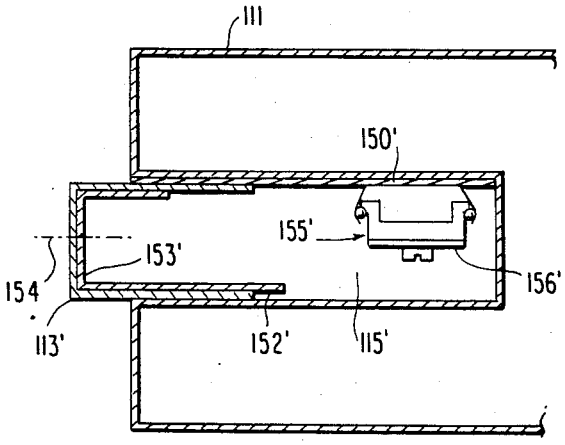
FIG. 6 is a sectional view taken on the line 6—6 of FIG. 5.
Figure 7:
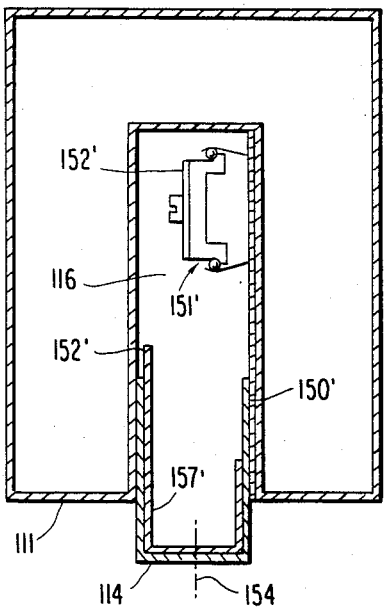
FIG. 7 is a sectional view taken on the line 7—7 of FIG. 5.

The cross-section of vertical plate 152' has a U shaped edge 153' as shown in FIGS. 6, 8 and 9 which serves to fasten thereon the upper end of blocking member 113', for example at points 154 of the same. In a similar manner, horizontal plate 156' has a U shaped cross-section 157' as shown in FIGS. 7, 8 and 9 which serves to fasten thereon the right end of horizontal blocking member 114, for example at points 154. According to the second embodiment of the present invention the outwards and backwards movements of the blocking members may be carried out with the co-operation of sliding ball bearings provided at each side of the frame housing slots.

Lastly, the added fluidtightness and soundproof features of an armoured door or the like which is provided with a blocking system in accordance with the present invention are provided by a very close contact between the adjacent ends of the blocking members when the protruding portions of these latter are inserted into the facing slots of a door wing in their blocking position. As shown in FIG. 1 relating to the first embodiment, the adjacent ends of horizontal blocking members 14, 14' and respective ends of vertical blocking members 13, 13' have a really very close proximity to each other along vertical lines 40, 40', 41, 41' at the four angles of closed wing 12. As shown in FIG. 5, the ends of blocking members are cut at 45° so that a really very close contact therebetween is provided along lines having such an inclination, as that which is indicated by the reference numeral 140'.

I claim:

1. A blocking system for doors, comprising a door frame, a door wing, and two pairs of mechanically interconnected blocking members disposed in slots in said frame and adapted to slide into confronting slots in the edges of the door wing, said blocking members comprising four bars one disposed in each of said frame slots and extending parallel to and adjacent an associated said edge of the door wing, rack and pinion means mechanically interconnecting said bars for conjoint movement into and out of the slots in the door wing thereby respectively to block and unblock the door wing, spring means continuously urging said bars toward said door wing slots, and a central control device on said door wing to push one said blocking member into its associated said housing slot thereby simultaneously to push all said blocking members into their respective housing slots.

2. A blocking system as claimed in claim 1, and pinions disposed one in each of four corners of said frame, said pinions engaging with racks secured to opposite ends of said bars to effect movement of said bars simultaneously toward and way from said door wing.

3. A blocking system as claimed in claim 1, in which said door frame and door wing are of hollow steel construction.

* * * * *